US007059910B1

(12) United States Patent
Chang

(10) Patent No.: US 7,059,910 B1
(45) Date of Patent: Jun. 13, 2006

(54) MULTI-FUNCTION CARD CONNECTOR WITH DEFEND MECHANISM

(75) Inventor: Eric (Wei-Cheng) Chang, Tu-chen (TW)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 11/169,846

(22) Filed: Jun. 28, 2005

(30) Foreign Application Priority Data

Mar. 11, 2005 (TW) ..... 94203786

(51) Int. Cl.
*H01R 24/00* (2006.01)

(52) U.S. Cl. ..... 439/630; 439/64; 439/541.5

(58) Field of Classification Search ..... 439/630, 439/633, 636, 64, 188, 541.5, 607
See application file for complete search history.

(56) References Cited

U.S. PATENT DOCUMENTS 6,402,529 B1 6/2002 Saito et al.
6,666,724 B1 * 12/2003 Lwee ..... 439/630
6,761,572 B1 * 7/2004 Chou ..... 439/188

* cited by examiner

*Primary Examiner*—Hien Vu
(74) *Attorney, Agent, or Firm*—Wei Te Chung

(57) ABSTRACT

A card connector comprises an insulating housing (1), at least a first set of contacts (2) and a second set of contacts (3) retained in the insulating housing (1) and a defend mechanism (6); the insulating housing (1) defines a card receiving space with a card inserting direction; the defend mechanism (6) disposes in the housing and comprising a step portion protruding into the card receiving space and a restorable portion extending from the step portion; the step portion divides the card receiving space into at least two card cavities according to external dimensions of the different cards and deflects between the two card cavities and protruding into one card cavity once a card inserted into the other card cavity; the restorable portion for urging the step portion to resume its original position once the card withdrew from the other cavity.

15 Claims, 15 Drawing Sheets

MULTI-FUNCTION CARD CONNECTOR WITH DEFEND MECHANISM

BACKGROUND OF THE INVENTION

1. Field of the Invention

The present invention relates to a card connector, especially to a card connector which is adapted for insertion of cards of different types.

2. Description of Related Art

With development of consuming products, such as portable telephones, digital cameras, PDA (Personal Digital Assistance), portable audio and the like, a lot of different kinds of cards, such as an SD (Super Density, Secure Digital) card, an MMC (Multi-Media Card), an SM (Smart Media) card, an MS (Memory Stick) card and an XD (XD-picture) card, are widely used in the field of the consuming products. Therefore, different card connectors are needed to load different cards. However, one card connector only loads one corresponding card, the above consuming product needs to be designed with different card connectors which occupy too much space and increase cost of the consuming product. Thus, a card connector which can load some different cards is required.

At present, a card connector which can load different cards has a plurality of inserting cavities for receiving different cards. In such situation, we must face to another problem which is to avoid accepting the different cards at a time. Because the card connector is needed to design special softwares and add inspecting contacts to expand its functions, thus, certainly encountering a lot of difficulties in design and manufacture.

Hence, an improved card connector is required to overcome the problems of the prior art.

SUMMARY OF THE INVENTION

An object of the present invention is to provide a card connector which is adapted for insertion of different kinds of cards and only loads one card at a time.

Accordingly, to achieve above-mentioned object, a card connector comprises an insulating housing, at least a first set of contacts and a second set of contacts and a defend mechanism; the insulating housing defines a card receiving space with a card inserting direction; the first set of contacts and the second set of contacts are retained in the insulating housing and exposed into the card receiving space for electrically connecting with corresponding cards; the defend mechanism disposes in the housing and comprising a step portion protruding into the card receiving space and a restorable portion extending from the step portion; the step portion divides the card receiving space into at least two card cavities according to external dimensions of the different cards and deflects between the two card cavities and protruding into one card cavity once a card inserted into the other card cavity; the restorable portion for urging the step portion to resume its original position once the card withdrew from the other cavity.

The detailed features of the present invention will be apparent in the detailed description with appropriate reference to the accompanying drawings.

DETAILED DESCRIPTION OF THE INVENTION

Figure 1:
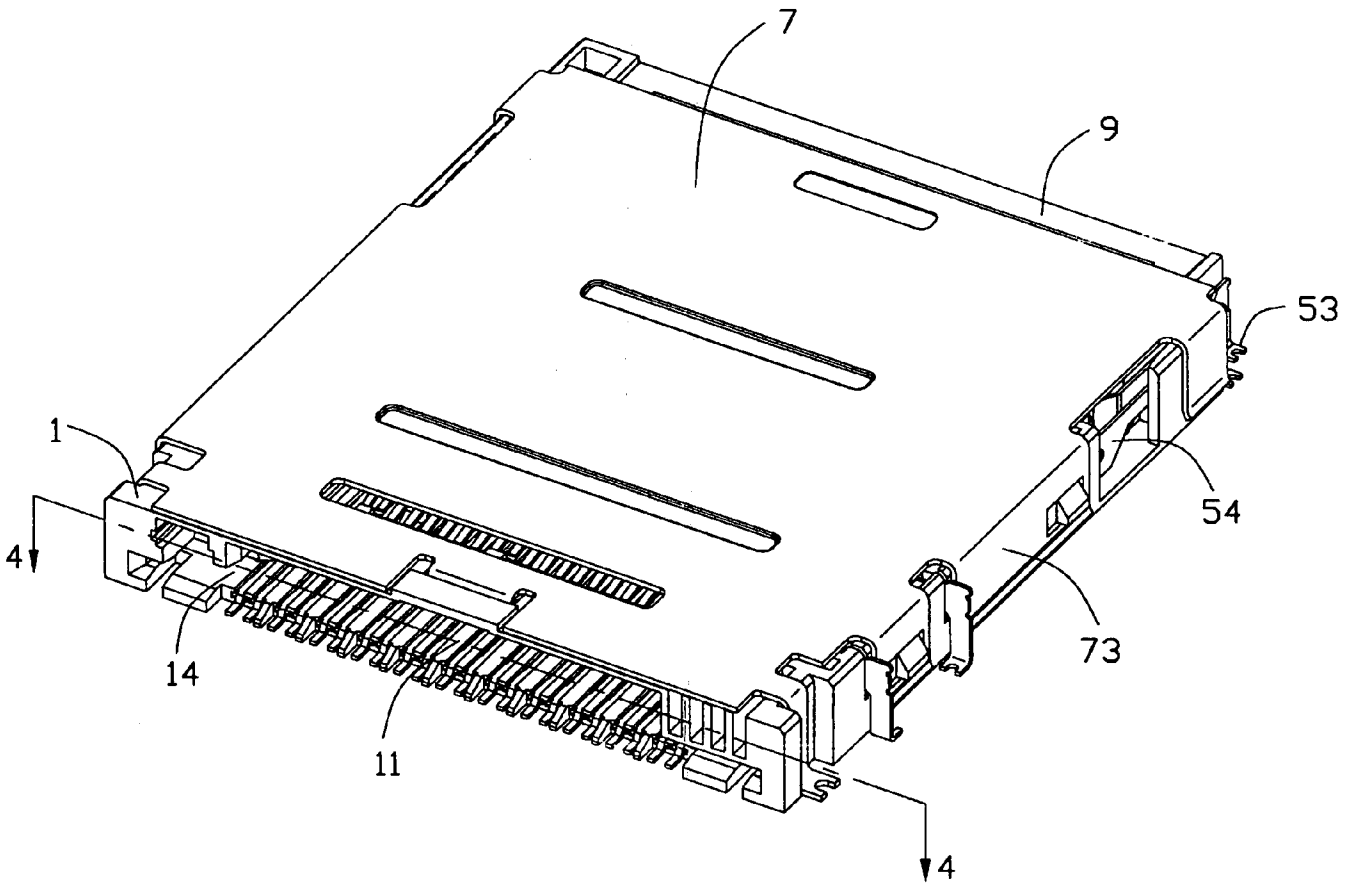
FIG. 1 is an assembled, perspective view of a card connector in accordance with the present invention.

Reference will now be made in detail to the preferred embodiment of the present invention.

Referring to FIGS. 1 to 5, a card connector in accordance with the present invention is adapted for insertion of different kinds of cards and only accepts one card at a time. The card connector comprises an insulating housing 1, a plurality of sets of contacts including a first set of contacts 2, a second set of contacts 3, a third set of contacts 4 and a fourth set of contacts 5 for electrically connecting with an XD card, an MS card, an SD/MMC card and an SM card respectively, a defend mechanism 6 and a shell 7.

The insulating housing 1 is approximately box-liked and comprises a top wall 10, a pair of opposite sidewalls 12, 13, a bottom wall 14 and a rear wall 15, which commonly define a card receiving space (not labeled). The insulating housing 1 further defines a card inserting opening 11 recessed inwardly from a front face thereof to communicate with the card receiving space. The top wall 10 is formed with an opening 100 communicating with the card receiving space and spaced from the card inserting opening 11 along a card inserting direction, and the top wall 10 is formed with a cut 101 adjacent to the front face of the housing 1. A longitudinally recessed cavity 133 and a transversely recessed notch 132 are defined in the sidewall 13 of the housing 1 adjacent to the card inserting opening 11 along a card inserting direction and communicating with each other. The cavity 133 communicates with the card receiving space at front end thereof. The shell 7 is disposed on the top wall 10 of the housing 1 and formed with a holding piece 76 at front end thereof to lock in the cut 101 of the housing 1.

The card connector is further provided with a first and a second holding plates 8, 8'. The first holding plate 8 and the second holding plate 8' are approximately plate configuration and disposed on the top wall 10 of the housing 1 to cover the opening 100 and face to the card receiving space. The first holding plate 8 is assembled on the second holding plate 8'.

The first set of contacts 2 are arranged in the first holding plate 8 and each comprises a contacting portion 21 exposed in the card receiving space adjacent to the card inserting opening 11 and a soldering portion 22 extending rearward from the contacting portion 21 beyond the rear wall 15 of the housing 1.

The second set of contacts 3 are disposed in contacting channels (not labeled) formed in the rear wall 15 of the housing 1. Each contact 3 comprises a contacting portion 31 exposed in the card receiving space and a soldering portion 32 extending through the rear wall 15 from the contacting portion 31 to expose outside.

The third set of contacts 4 are received in the second holding plate 8' and each comprises a contacting portion 41 exposed in the card receiving space and a soldering portion 42 extending rearward from the contacting portion 41 and exposed outside the rear wall 15. The soldering portions 42 are divided into two groups to leave a space therebetween. The contacting portions 31 of the second set of the contacts 3 are located in the space. In addition, the third set of contacts 4 further comprise a sensor switch 43 disposed at a distal end thereof with the contacting portion 41 thereof differed from those of the other contacts 4. A grounding contact 44 and a protecting contact 45 are further included in the third set of contacts 4 and respectively disposed in the sidewall 12.

Figure 2:
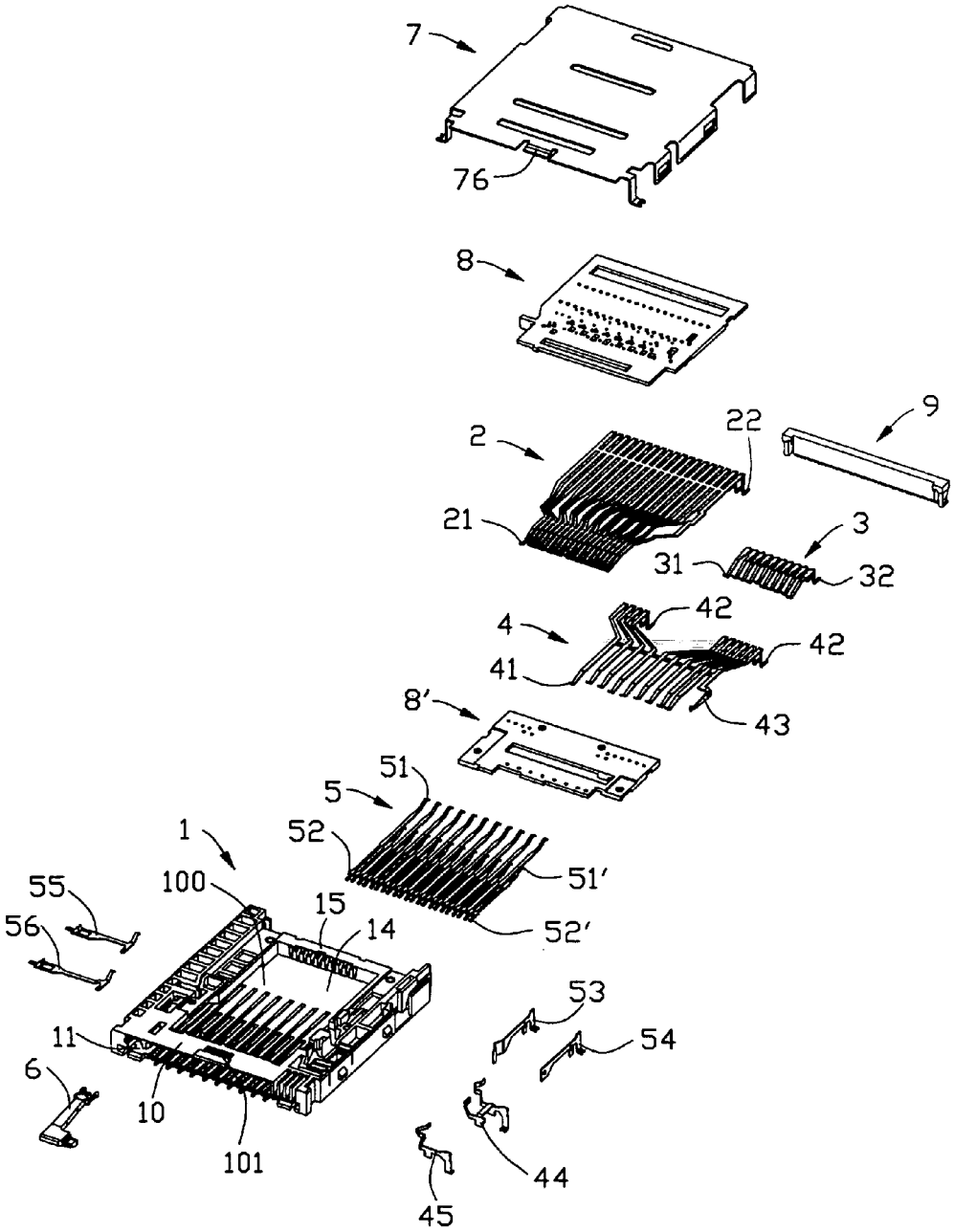
FIG. 2 is an exploded perspective view of the card connector shown in FIG. 1.
Figure 3:
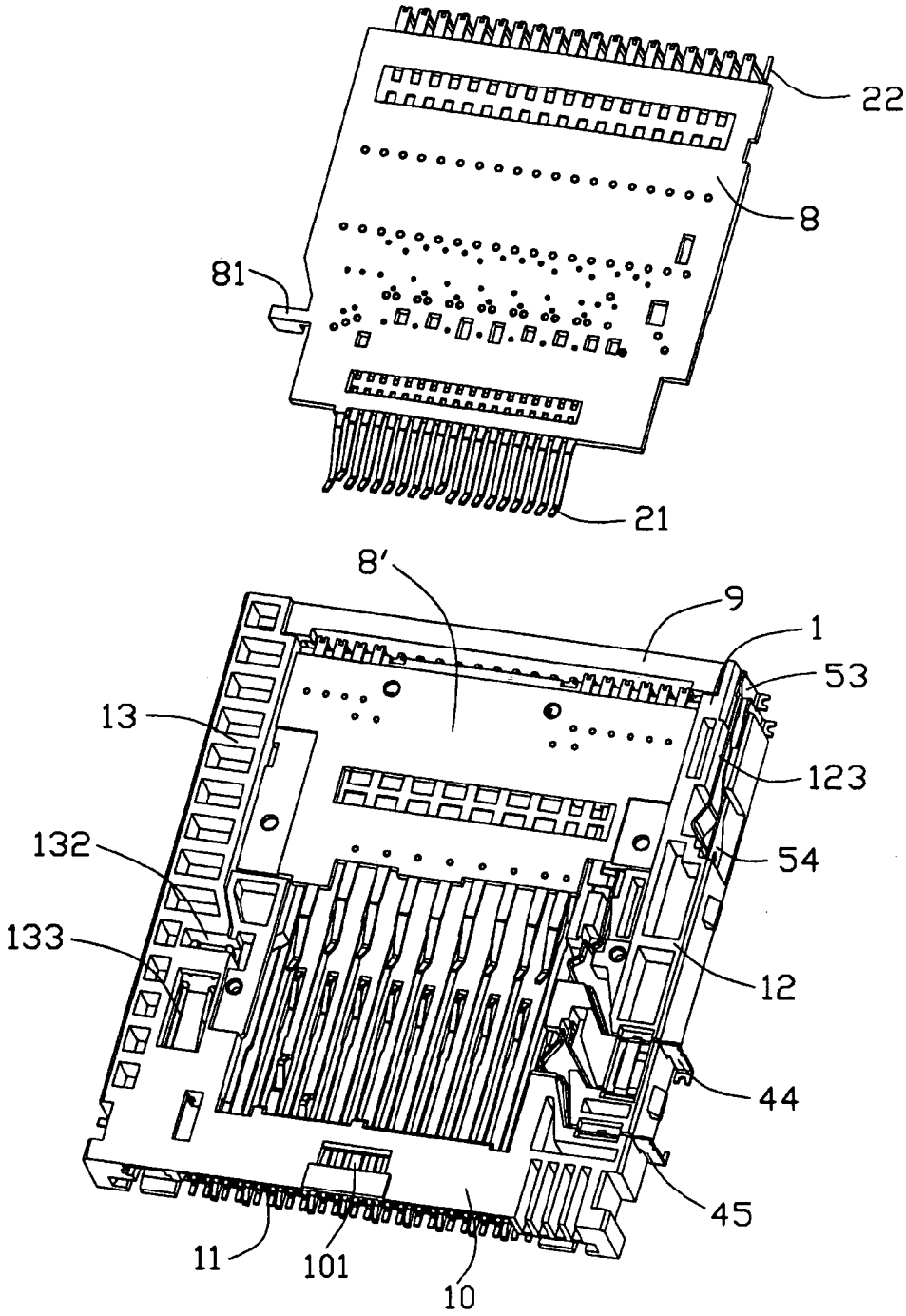
FIG. 3 is a partially assembled, perspective view of the card connector shown in FIG. 2.
Figure 6:
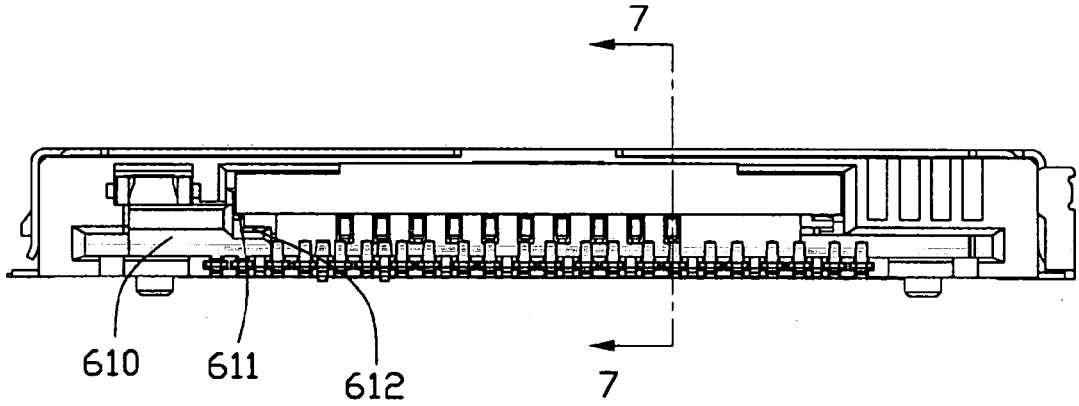
FIG. 6 is a front elevational view of the card connector in accordance with the present invention, showing an XD card inserted therein.

Referring to FIGS. 2, 3 and 6, the fourth set of contacts 5 are disposed on the bottom wall 14 and comprise two rows of contacting members with different lengths and arranged alternately. The contacting members comprise contacting portions 51, 51' exposed in the card receiving space 130 and soldering portions 52, 52' extending forwardly from the contacting portions 51, 51' to expose outside the front face of the housing 1. The length of the contacting portion 51 is longer than that of the contacting portion 51'. A sensor contact 53 and a grounding contact 54 are disposed in the sidewall 12 of the housing 1 adjacent to the rear wall 15 and read/written contacts 55, 56 are disposed in the sidewall 13 of the housing 1 adjacent to the front face of the housing 1.

Figure 7:
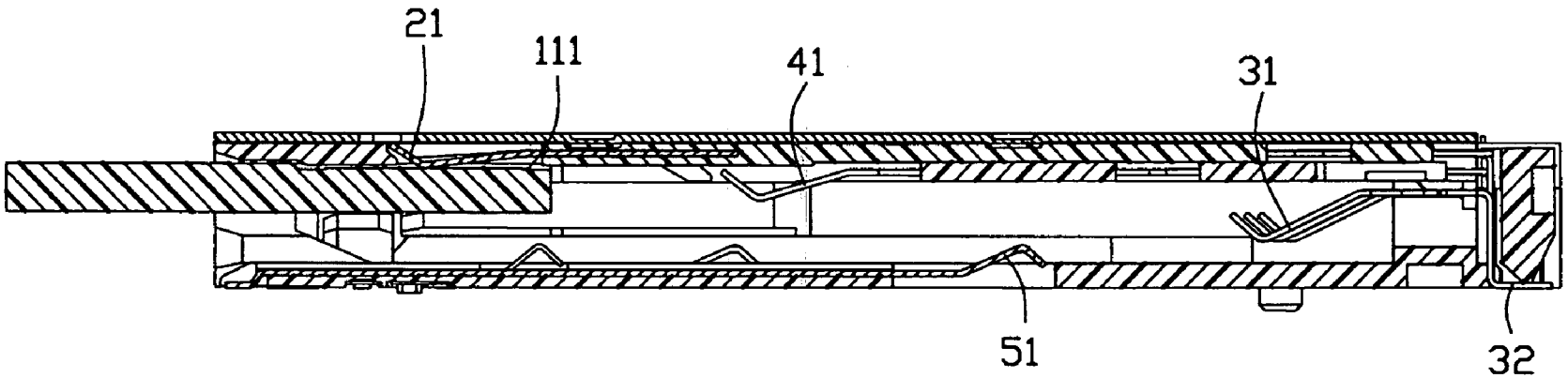
FIG. 7 is a cross-sectional view along line 7—7 of FIG. 6.
Figure 8:
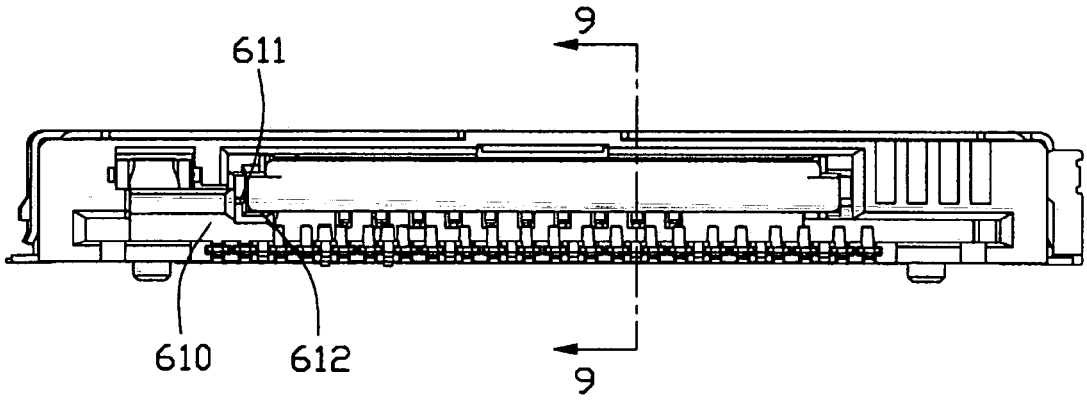
FIG. 8 is a front elevational view of the card connector in accordance with the present invention, showing an SD card inserted therein.

Referring to FIGS. 2 and 7, the contacting portions 21, 41, 51 and 31 are arranged in turn along the card inserting direction. A rectangular holding member 9 is assembled to the rear wall 15 of the housing 1 in the card inserting direction to separate and hold the soldering portions 22, 32 and 42 of the corresponding contacts 2, 3 and 4 in position.

Figure 4:
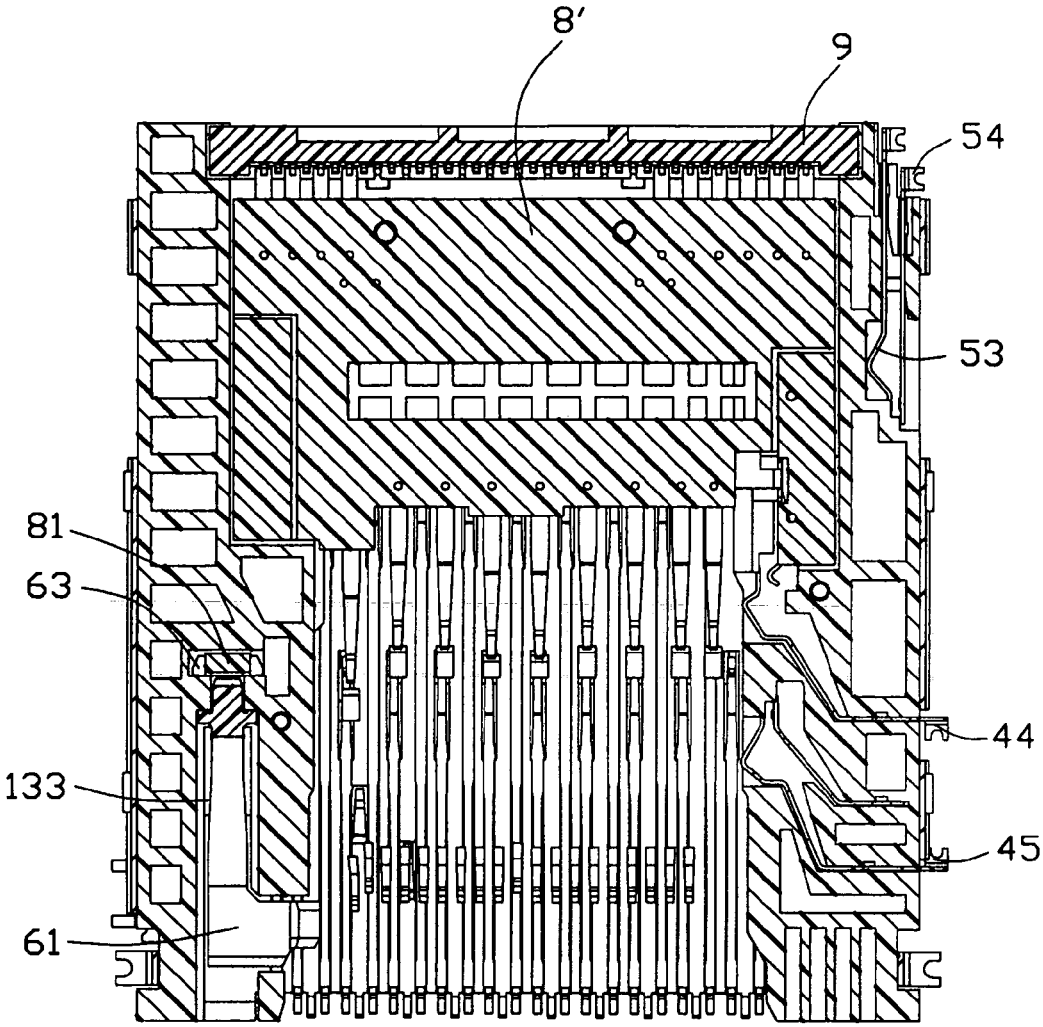
FIG. 4 is a cross-sectional view of the card connector along line 4—4 of FIG. 1, showing a defend mechanism assembled in an insulating housing.
Figure 5:
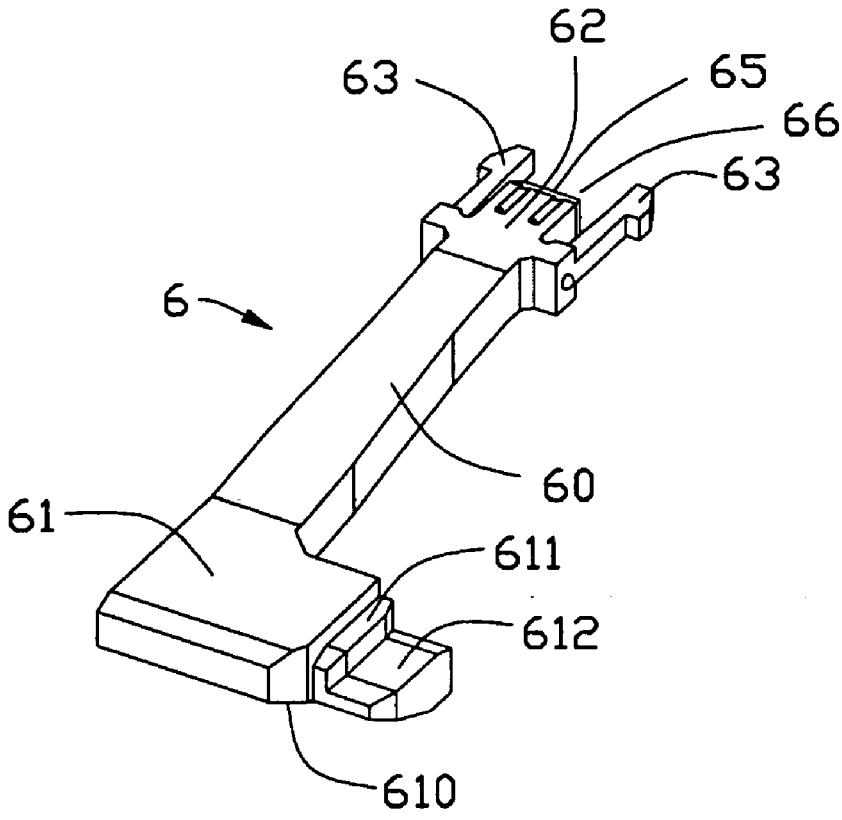
FIG. 5 is a perspective view of the defend mechanism of the card connector in accordance with the present invention.
Figure 9:
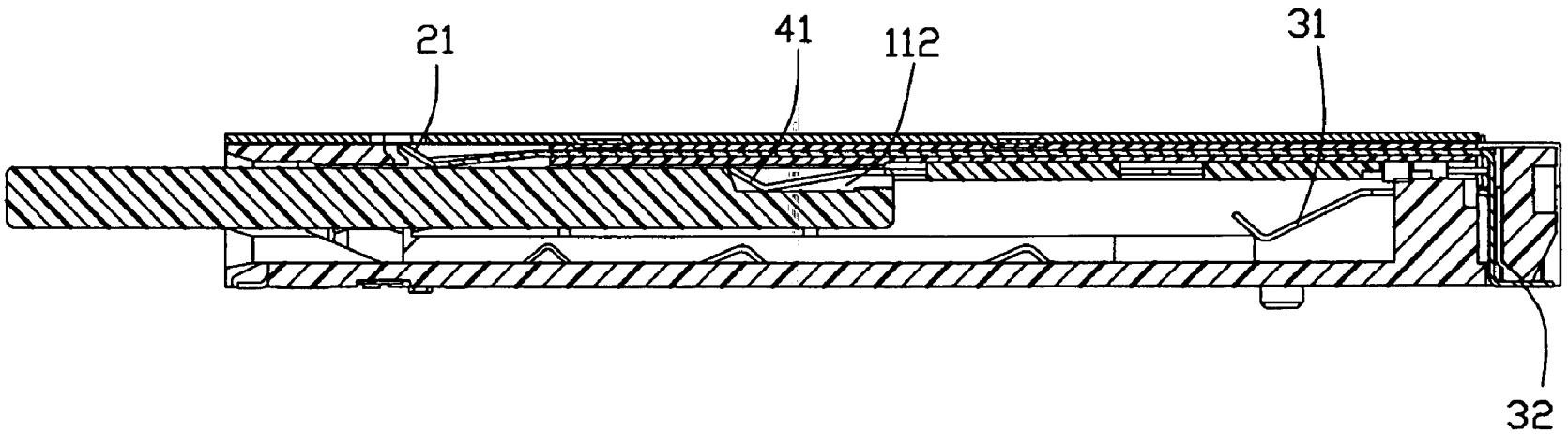
FIG. 9 a cross-sectional view along line 9—9 of FIG. 8.
Figure 10:
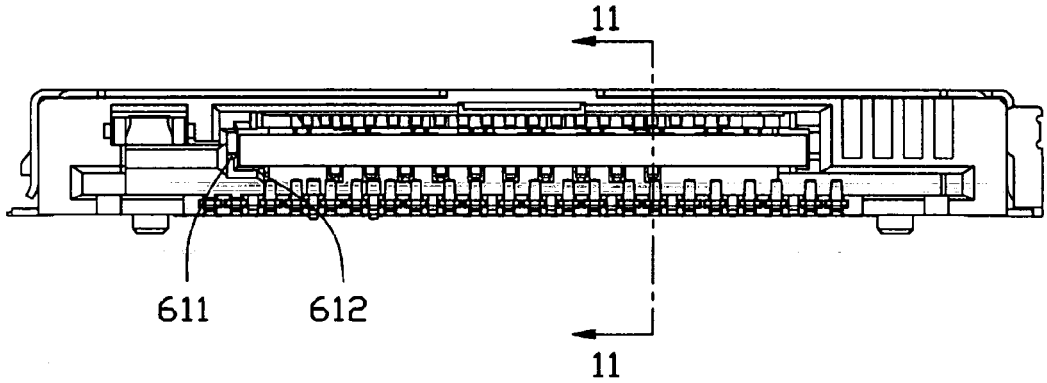
FIG. 10 is a front elevational view of the card connector in accordance with the present invention, showing an MMC card inserted therein.
Figure 11:
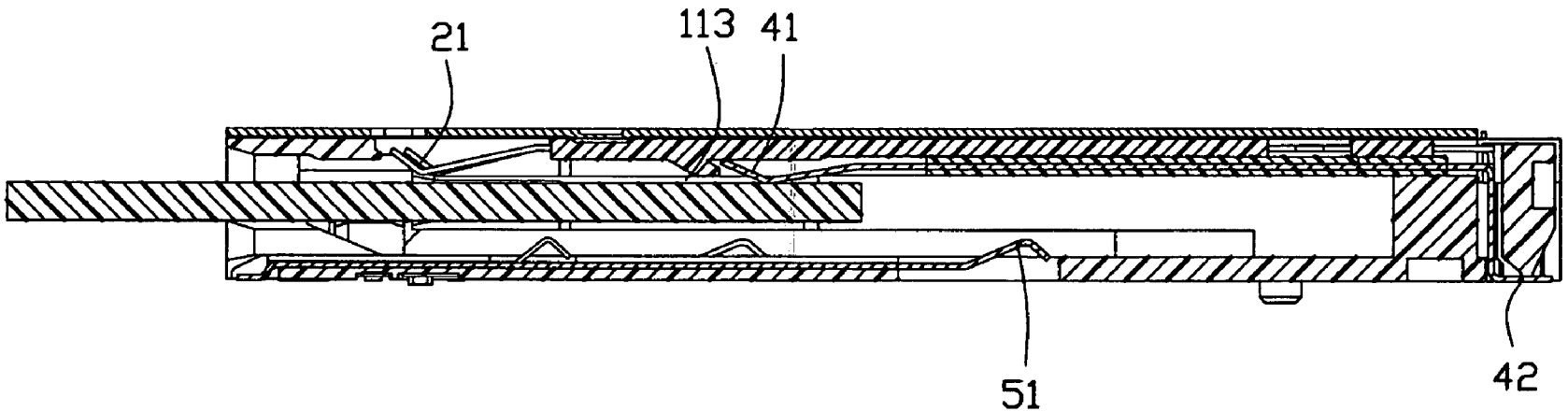
FIG. 11 is a cross-sectional view along line 11—11 of FIG. 10.
Figure 12:
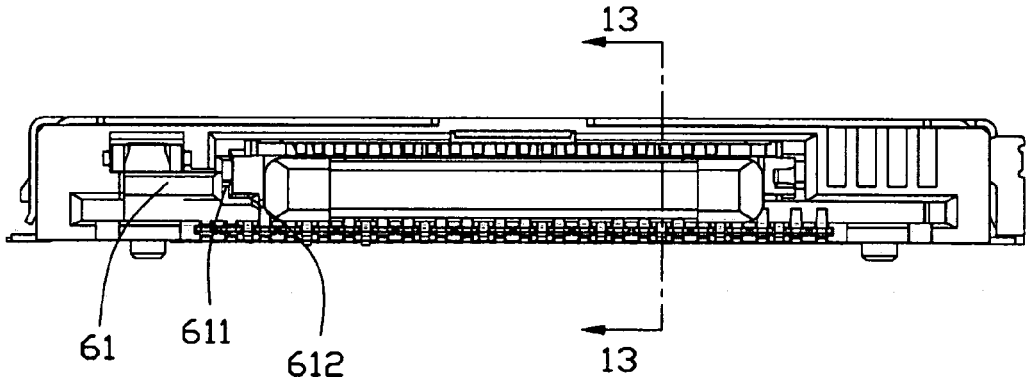
FIG. 12 is a front elevational view of the card connector in accordance with the present invention, showing an MS card inserted therein.
Figure 13:
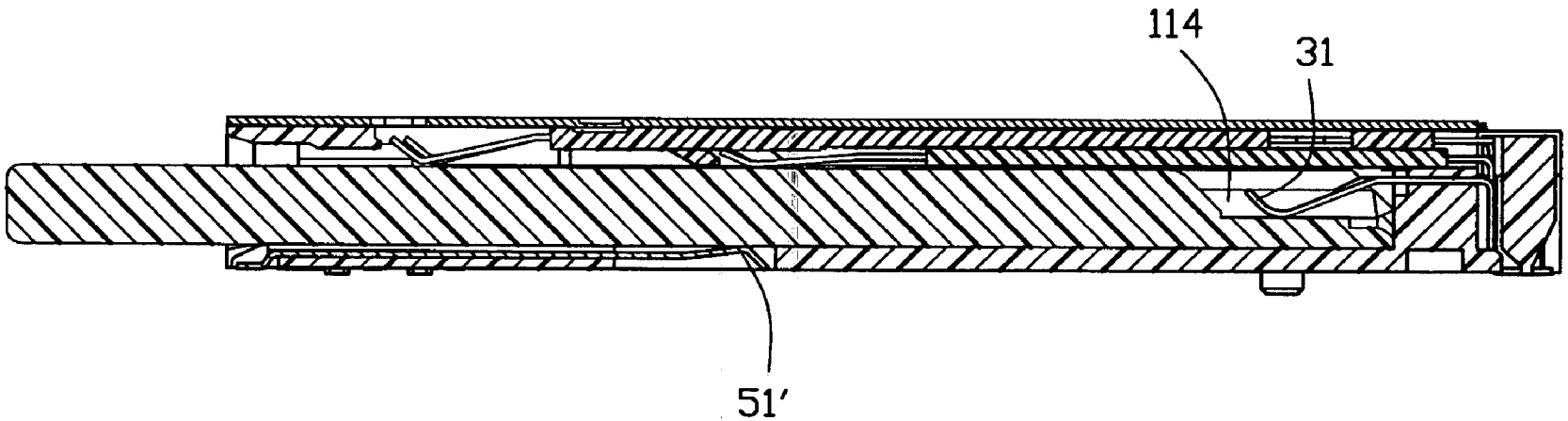
FIG. 13 is a cross-sectional view along line 13—13 of FIG. 12.
Figure 14:
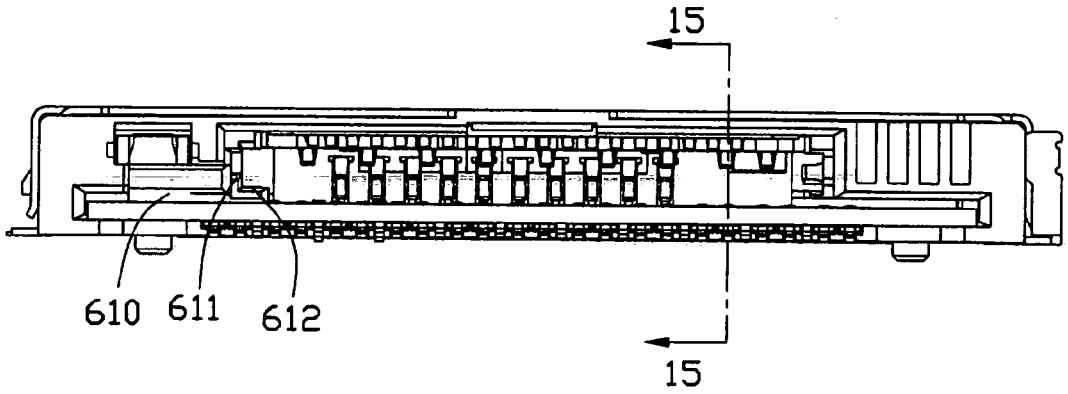
FIG. 14 is a front elevational view of the card connector in accordance with the present invention, showing an SM card inserted therein.
Figure 15:
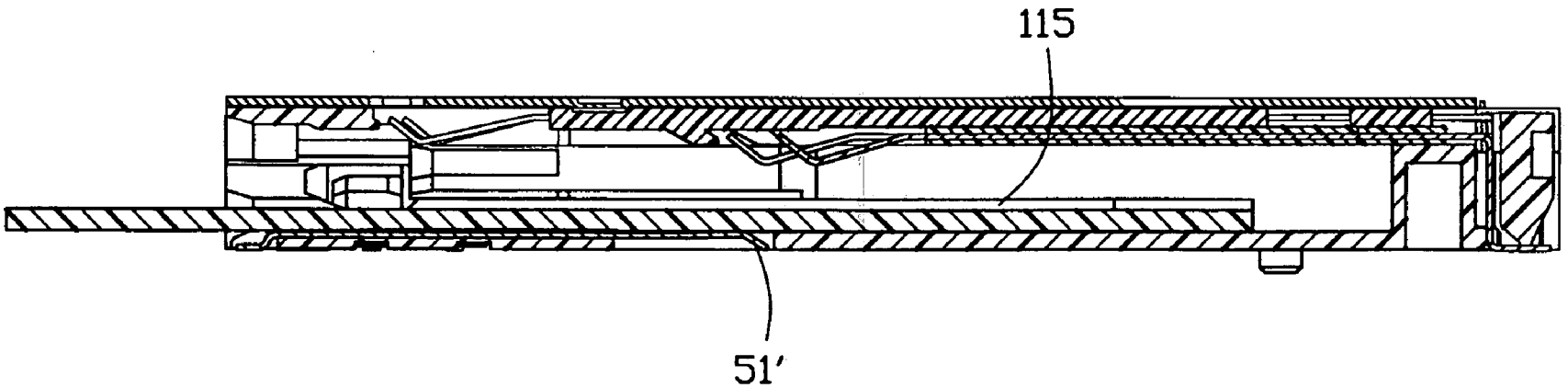
FIG. 15 is a cross-sectional view along line 15—15 of FIG. 14.

Referring to FIGS. 3 to 5, the card connector comprises a defend mechanism 6 assembled in the housing 1. The defend mechanism 6 is approximately L-shaped and comprises a head portion 61, a tail portion 62 and an intermediate portion 60 connecting the head portion 61 and the tail portion 62. The tail portion 62 is locked in the notch 132 and the intermediate portion 60 is cantilevered in the recess 133 of the sidewall 13 of the housing 1. The tail portion 62 comprises a protruding block 65 protruding backward from the distal end thereof and a pair of locking arms 63 disposed at opposite sides of the protruding block 65 and extending backward with distal ends extending beyond a rear face of the protruding block 65. A gap 66 is formed between the distal ends of the protruding block 65 and the locking arms 63 for receiving a positioning portion 81 extending from one side of the first holding plate 8 (referring to FIG. 4). Each locking arm 63 locks in the notch 132 for positioning the defend mechanism 6. The head portion 61 is exposed in the card receiving space adjacent to the card inserting opening 11 and comprises a step portion including an upper step section 611 extending toward the sidewall 12 of the housing 1 from one side of the header portion 61 and a lower step section 612 extending from lower side of the upper step section 611 toward the sidewall 12. For illustrating the different card cavities conveniently, thus defining these cavities associated with corresponding cards inserted therein. Therefore, the upper step section 611 and the lower step section 612 divide the card receiving space into an XD card cavity 111 as a first card cavity (referring to FIG. 7), SD/MMC card cavities 112 and 113 as second and third card cavities (referring to FIGS. 9 and 11), an MS card cavity 114 as a fourth card cavity (referring to FIG. 13) and an SM card cavity 115 as a fifth card cavity (referring to FIG. 15) in turn along a vertical direction according to external dimensions of the corresponding different cards. The upper step section 611 and the lower step section 612 are further for guiding insertion of the different cards. The different contacts 2, 3, 4 and 5 are exposed in the corresponding different card cavities 111, 114, 112/113 and 115 respectively. The header portion 61 can deflect into the different card cavities along the vertical direction as different cards inserted into the card connector. The tail portion 62 and the intermediate portion 60, served as restorable portion, can urge the header portion 61 return to its original position. The header portion 61 is formed with a slanted face 610 at front end thereof, and the upper step section 611 and the lower step section 612 are also formed with corresponding inclined faces (not labeled) all for guiding insertion of card.

Referring to FIGS. 6 to 15, the XD card cavity 111, the SD/MMC card cavities 112, 113 and the MS card cavity 114 communicate with and overlap one another. The SD/MMC card cavities 112, 113, the MS card cavity 114 and the SM card cavity 115 also communicate with and overlap one another. The XD card cavity 111 and the SM card cavity 115 are independent card cavities and the XD card cavity 111 is defined between the top wall 10 of the housing 1 and the header portion 61.

When only the XD card is inserted into the XD card cavity 111, the XD card will force the head portion 61 into the SD/MMC card cavities 112, 113 and the SM card cavity 115. When only the SM card is inserted into the SM card cavity 115, the header portion 61 will rotate about the intermediate portion 62 and the tail portion 62 and then be forced into the XD card cavity 111 and the SD/MMC card cavities 112, 113. Thus, when either card of the XD card, the MS card, the SD/MMC card or the SM card is inserted into the corresponding card cavities 111, 112/113, 114 and 115 to electrically connect with the corresponding contacts 2, 3, 4 and 5, other cards can't be inserted into the card receiving space at the same time. That is to say, the card connector can accept one card at a time.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector, comprising:

an insulating housing defining a card receiving space with a card inserting direction;

at least a first set of contacts and a second set of contacts retained in the insulating housing and exposed into the card receiving space for electrically connecting with corresponding cards; and a defend mechanism disposed in the housing and comprising a step portion protruding into the card receiving space and a restorable portion extending from the step portion, the step portion dividing the card receiving space into at least two card cavities for fitting to external dimensions of the different cards, and the step portion deflected between the two card cavities and protruding into one card cavity once a card inserted into the other card cavity, and the restorable portion for urging the step portion to resume a original position once the card withdrew from the other cavity;

wherein the restorable portion comprises a tail portion secured to the insulating housing and an intermediate portion extending from the tail portion and connecting with the step portion;

wherein the tail portion comprises a protruding backward from a free end thereof and a pair of locking arms disposed at opposite sides of the protruding block, and wherein the locking arms are locked in a notch of the insulating housing.

2. The card connector as described in claim 1, wherein the defend mechanism is assembled to the insulating housing along the card inserting direction.

3. The card connector as described in claim 1, wherein the step portion comprises an upper step section extending therefrom and a lower step section extending from lower side of the upper step section along a transverse direction perpendicular to the card inserting direction.

4. The card connector as described in claim 1, wherein the step portion partially protrudes into at least one cavity in its original position.

5. The card connector as described in claim 1, wherein the step portion is unitary with the restorable portion and formed at a free end of the restorable portion, and wherein the other end opposite to the free end of the restorable portion is securely mounted on the housing.

6. The card connector as described in claim 1, wherein the intermediate portion is received and cantilevered in a recess of the insulating housing.

7. The card connector as described in claim 1, further comprising a first holding plate provided with a positioning portion at front end thereof, and wherein the locking arms and the protruding block together define a gap to receive the positioning portion.

8. The card connector as described in claim 1, wherein further comprising a shell covered the insulating housing, and wherein the shell is formed with a holding piece at front end thereof to lock in a cut formed at a top wall of the insulating housing 1.

9. The card connector as described in claim 1, wherein the first set of contacts and the second set of contacts respectively comprise contacting portions spaced with each other and arranged along the card inserting direction.

10. The card connector as described in claim 9, wherein the first set of contacts and the second set contacts respectively comprise soldering portions exposed outside a rear wall of the insulating housing, and a holding member assembled to the rear wall to separate and hold the different soldering portions.

11. A stacked electrical card connector assembly for use with at least first, second and third different type cards, comprising:

an insulative housing sub-assembly defining a common entrance and a common card receiving cavity;

first, second and third groups of contacts being arranged in the housing sub-assembly for respective engagement with the corresponding first, second and third cards;

first, second and third card receiving spaces defined in the common card receiving cavity with an overlapped manner between at least two of said three receiving spaces; and a moveable defend mechanism disposed in the housing and comprising a step portion protruding into the card receiving cavity and a restorable portion extending from the step portion, the step portion dividing the card receiving cavity into at least two card spaces for fitting to external dimensions of the different cards; wherein insertion of any one of said first, second and third cards into the common card receiving cavity through the common entrance, will preclude the other two of said three cards at least either by interference between the other card and the already inserted card due to the overlapping manner or by the said defend mechanism blocking a passing way for entering the corresponding card receiving space;

wherein the restorable portion comprises a tail portion secured to the insulating housing and an intermediate portion extending from the tail portion and connecting with the step portion;

wherein the tail portion comprises a protruding backward from a free end thereof and a pair of locking arms disposed at opposite sides of the protruding block.

12. The assembly as claimed in claim 11, wherein said defend mechanism performs a blocking function either in a relaxed position or an urging position.

13. The assembly as claimed in claim 12, wherein said defend mechanism blocks a thinner one of said three cards at the relaxed position when the thick card is already received in the corresponding card receiving space, and blocks a thicker one of said three cards at the urging position when the thin card is already received in the corresponding card receiving space.

14. The assembly as claimed in claim 11, wherein said defend mechanism is moveable in a vertical direction perpendicular to an insertion direction of the card.

15. The assembly as claimed in claim 13, wherein said defend mechanism is configured to be actuated to move by the thin card for insertion of the thin card if no thick card engages therewith.

* * * * *